US010451264B2

(12) United States Patent
Pearson et al.

(10) Patent No.: US 10,451,264 B2
(45) Date of Patent: Oct. 22, 2019

(54) WATER RESISTANT LED LIGHT FIXTURES

(71) Applicant: Tempo Industries, LLC, Irvine, CA (US)

(72) Inventors: Dennis Pearson, Foothill Ranch, CA (US); Michael D. Bremser, Seal Beach, CA (US); Thomas Lueken, Beaumont, CA (US); Jennifer Maarburg, Santa Ana, CA (US)

(73) Assignee: Tempo Industries, LLC, Irvine, CA (US)

( * ) Notice: Subject to any disclaimer, the term of this patent is extended or adjusted under 35 U.S.C. 154(b) by 0 days.

(21) Appl. No.: 15/926,925

(22) Filed: Mar. 20, 2018

(65) Prior Publication Data

US 2019/0293276 A1 Sep. 26, 2019

(51) Int. Cl.

| | |
|---|---|
| ***F21V 33/00*** | (2006.01) |
| ***F21V 31/00*** | (2006.01) |
| ***F21V 21/14*** | (2006.01) |
| *F21Y 115/10* | (2016.01) |

(52) U.S. Cl.
CPC ..... *F21V 31/005* (2013.01); *F21V 21/14* (2013.01); *F21Y 2115/10* (2016.08)

(58) Field of Classification Search
CPC .... F21V 21/14; F21V 31/005; F21Y 2115/10; F21S 4/20; F21S 4/28
See application file for complete search history.

(56) References Cited

U.S. PATENT DOCUMENTS

| | | | | |
|---|---|---|---|---|
| 3,030,670 | A | 4/1962 | Bigelow | |
| 5,270,911 | A * | 12/1993 | Maglica | B62J 6/00 248/288.51 |
| 5,620,369 | A | 4/1997 | Spransy et al. | |
| 6,351,920 | B1 | 3/2002 | Hopkins et al. | |
| 6,457,841 | B1 * | 10/2002 | Lynch | F21L 4/045 362/197 |
| 6,805,470 | B1 * | 10/2004 | Ward | F21V 17/18 362/223 |
| 6,905,223 | B2 * | 6/2005 | Halasz | F21L 4/00 362/187 |
| 7,658,518 | B2 | 2/2010 | Shwisha | |
| 7,726,840 | B2 | 6/2010 | Pearson et al. | |
| 7,828,456 | B2 | 11/2010 | Boyer et al. | |

(Continued)

FOREIGN PATENT DOCUMENTS

| | | | |
|---|---|---|---|
| CA | 2724053 A1 * | 6/2011 | F21V 3/00 |
| DE | 102009016753 A1 | 10/2010 | |

(Continued)

OTHER PUBLICATIONS

EPO 15159756.4 extended European search report, dated Apr. 12, 2015.

(Continued)

*Primary Examiner* — Anabel Ton
(74) *Attorney, Agent, or Firm* — Lapple Ubell IP Law, LLP; Franklin D. Ubell

(57) ABSTRACT

A water resistant LED light fixture having a fixture body with a water tight wire sealing compartment and a mounting mechanism for mounting the light fixture and enabling it to be positioned at various selected angles to facilitate aiming of the illumination provided by the fixture.

30 Claims, 11 Drawing Sheets

(56) References Cited

U.S. PATENT DOCUMENTS

| | | | | |
|---|---|---|---|---|
| 8,002,426 | B2 * | 8/2011 | Pearson | E04F 11/1834 362/146 |
| 8,061,870 | B2 | 11/2011 | Pearson et al. | |
| 8,398,274 | B2 * | 3/2013 | Parker | F21V 5/00 359/599 |
| 8,398,276 | B2 | 3/2013 | Pearson et al. | |
| 9,062,840 | B2 | 6/2015 | Swisha et al. | |
| 9,217,247 | B2 | 12/2015 | Behling et al. | |
| 2005/0073837 | A1 * | 4/2005 | Jian | F21L 4/045 362/199 |
| 2005/0117333 | A1 * | 6/2005 | Yoshida | F21S 8/033 362/147 |
| 2006/0238136 | A1 | 10/2006 | Johnson et al. | |
| 2009/0262532 | A1 | 10/2009 | Wilcox et al. | |
| 2010/0259931 | A1 | 10/2010 | Chemel et al. | |
| 2011/0317435 | A1 * | 12/2011 | Wang | F21V 21/025 362/370 |
| 2012/0051041 | A1 | 3/2012 | Edmond et al. | |
| 2012/0063138 | A1 | 3/2012 | Leadford et al. | |
| 2012/0091903 | A1 | 4/2012 | Bembridge et al. | |
| 2012/0235579 | A1 | 9/2012 | Chemel et al. | |
| 2013/0021792 | A1 | 1/2013 | Snell et al. | |
| 2013/0070461 | A1 | 3/2013 | Pickard | |
| 2013/0176722 | A1 | 7/2013 | Lay et al. | |
| 2013/0201674 | A1 | 8/2013 | Pickard et al. | |
| 2013/0208457 | A1 | 8/2013 | Durkee et al. | |
| 2013/0208469 | A1 | 8/2013 | Progl | |
| 2013/0250567 | A1 | 9/2013 | Edmond et al. | |
| 2013/0271979 | A1 | 10/2013 | Pearson et al. | |
| 2013/0272000 | A1 | 10/2013 | Pearson et al. | |
| 2013/0279165 | A1 | 10/2013 | Pearson et al. | |
| 2013/0279179 | A1 | 10/2013 | Pearson et al. | |
| 2013/0279180 | A1 | 10/2013 | Pearson et al. | |
| 2014/0016315 | A1 | 1/2014 | Yu | |
| 2016/0003457 | A1 | 1/2016 | Pearson et al. | |
| 2016/0014869 | A1 | 1/2016 | Pearson et al. | |
| 2016/0238202 | A1 | 8/2016 | Mallory et al. | |
| 2016/0298832 | A1 * | 10/2016 | Pearson | F21V 23/002 |
| 2016/0327217 | A1 | 11/2016 | Pearson et al. | |
| 2017/0138578 | A1 | 5/2017 | Pearson et al. | |

FOREIGN PATENT DOCUMENTS

| | | | |
|---|---|---|---|
| DE | 102010001777 | A1 | 8/2011 |
| EP | 2 051 001 | A2 | 4/2009 |
| EP | 2 489 931 | A2 | 8/2012 |
| WO | 2011139764 | A2 | 11/2011 |
| WO | 2012129243 | A1 | 9/2012 |

OTHER PUBLICATIONS

EPO 17175125.8 extended European search report, dated Oct. 10, 2017.

* cited by examiner

WATER RESISTANT LED LIGHT FIXTURES

BACKGROUND OF THE DISCLOSURE

Field of the Disclosure

The subject disclosure relates to LED light fixtures and particularly to such fixtures exhibiting water resistance and having an aimable mounting feature.

Description of Related Art

Various LED electric light fixtures have been constructed in the past, for example, such as those disclosed in U.S. Pat. Nos. 7,726,840 and 8,864,347, both assigned to Tempo Industries, LLC.

SUMMARY

In illustrative embodiments, an LED light fixture is provided comprising a fixture body, a printed circuit board carrying one or more LEDs located within the fixture body, and a lens removably attachable to the fixture body. A wire sealing compartment is located on an underside of the fixture body and has an open interior space configured to receive first and second electrical leads. First and second gaskets are configured to sealingly mate with an interior surface of the wire sealing compartment and to sealingly engage the first and second electrical leads at respective entry and exit points of the wire sealing compartment. A snap-in cover compresses the gaskets and closes a bottom opening of the wire sealing compartment, and a slide cover lock is provided to lock the snap-in cover in place.

In one embodiment, the wire sealing compartment may comprise respective parallel vertical sidewalls with orthogonally disposed vertical entry and exit walls, wherein the exit and entry walls have respective entry and exit openings formed therein. The entry opening includes a pair of wire entry channels shaped to receive and pass the first and second electrical leads as they enter the wire sealing compartment, while the exit opening includes a pair of wire exit channels shaped to receive and pass the first and second electrical leads as they exit the wire sealing compartment. In one embodiment, the wire sealing compartment may further include first and second vertical ribs respectively spaced apart from and running parallel to each of the vertical sidewalls, the vertical ribs defining respective channels into which each of the first and second gaskets fit.

According to one embodiment, apparatus for mounting the light fixture is further provided comprising a receptacle shaped to receive and hold the light fixture and a turret mechanism for pivotally mounting the receptacle. In an illustrative embodiment, the turret mechanism comprises a cradle component and a bracket component. The cradle component has a semicircular exterior surface and a plurality of ratchet teeth located in first and second semicircular channels positioned on respective sides of the cradle component. The bracket component is configured to receive and mount the receptacle and has a semicircular interior surface shaped to pivotally mate with the semicircular exterior surface of the cradle component. A spring component is attached to the bracket component and is configured to engage the ratchet teeth such that the bracket component may be pivoted to a selected angle and fixed in position at that angle.

DETAILED DESCRIPTION

Figure 1:
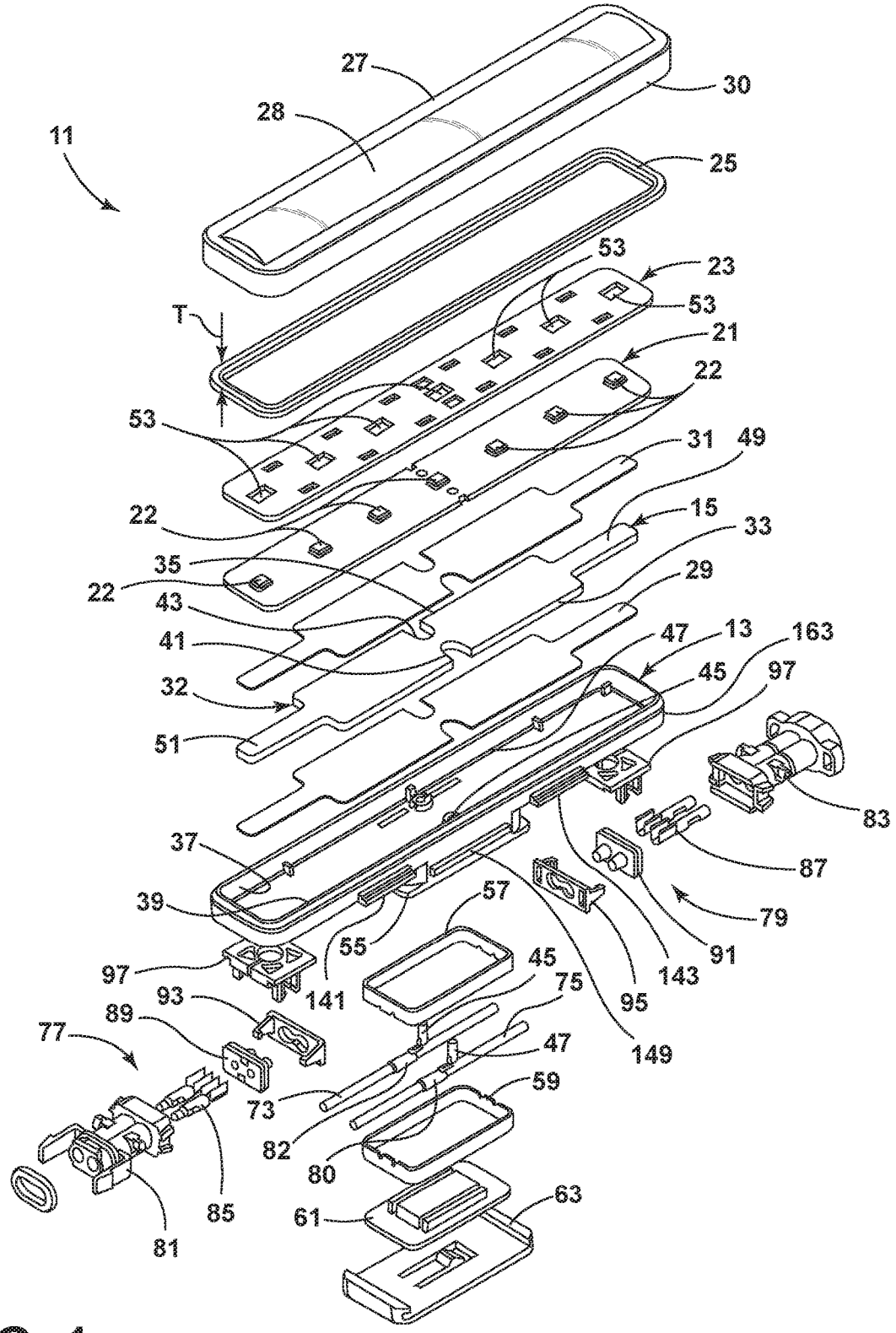
FIG. 1 is an exploded perspective view of LED light fixture apparatus according to an illustrative embodiment.

An illustrative LED light fixture apparatus 11 is shown in FIG. 1. The apparatus 11 includes a fixture body 13, a mounting plate 15, an LED circuit board 21 (PCB) carrying one or more LEDS 22, a PCB cover 23, a gasket 25, and a light transmissive cover or lens 27. In an illustrative embodiment, the mounting plate 15 is attached to the fixture body 13 by double sided thermal adhesive tape 29 and the LED circuit board 21 is attached to the mounting plate 15 by a second layer 31 of double sided thermal adhesive tape. The PCB cover 23 fits over the LED circuit board 21 and is held in place by the lens 27.

Figure 3:
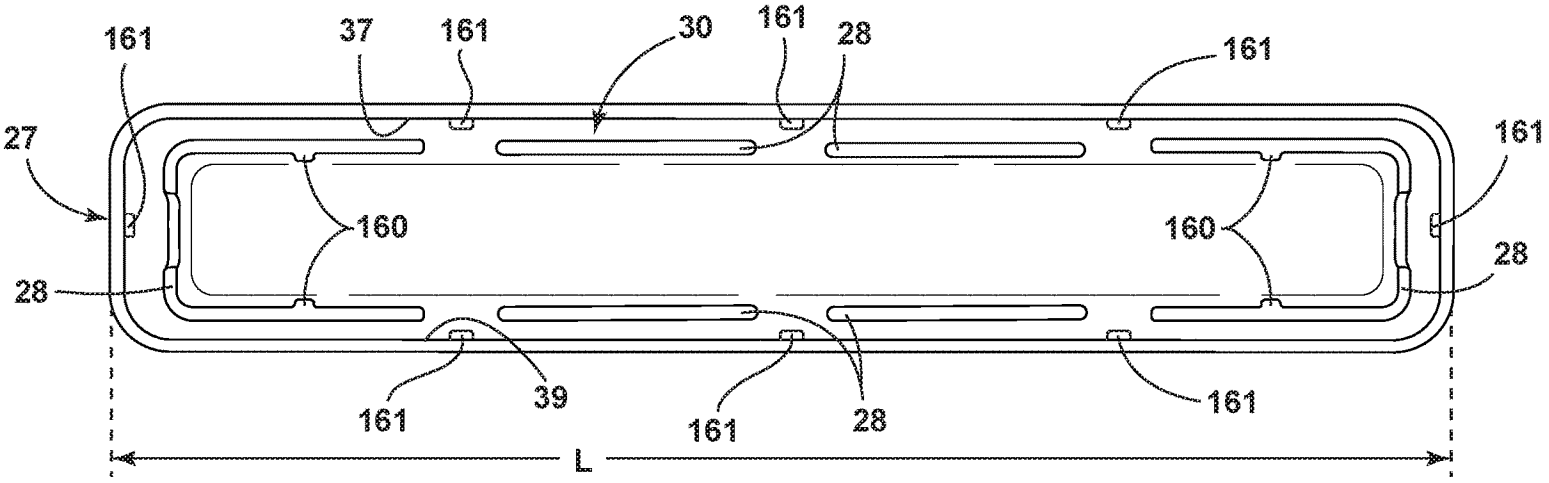
FIG. 3 is a bottom view of the lens component of FIG. 1.

As shown in FIG. 3, internal vertical ribs 28 extend from the interior floor of the cover 27 parallel to its inside vertical surfaces 37, 39 to form a channel 30 which receives and holds the gasket 25. The lens 27 is shaped to snap into place on the fixture body 13 and to simultaneously compress the gasket 25 to achieve a watertight seal. In one embodiment, the thickness T of the lens gasket 27 is 0.070 inches and the gasket 27 will compress 20% when fully assembled. The depth of the channel 30 is selected to accommodate the thickness of the gasket 25 while enabling it to compress to the desired extent. The internal vertical ribs 28 further have horizontal tabs 161 extending therefrom which snap-fit with a horizontal peripheral rib 163 formed on the fixture body 13 to thereby facilitate snap-fit attachment of the cover 27 to the fixture body 13. In one embodiment, the cover 27 may have a length "L" of six inches.

As further illustrated in FIG. 1, in the illustrative embodiment, the mounting plate 15 functions as a heat sink and includes a generally rectangular central portion 32, whose edges 33, 35 fit adjacent the inner vertical sides 37, 39 of the fixture body 13. The mounting plate 15 includes respective notches 41, 43, through which pass respective vertically disposed electrical contact pins 45, 47. First and second rectangular tongues 49, 51 extend from each end of the mounting plate 15 and are of a lesser width than the rectangular portion 31. The tongues extend the heat conduction of the mounting plate to the end most LEDs 22 on the PCB 21. The respective thermal adhesive tape layers 29, 31 have the same shape as the mounting plate 15.

The PCB cover 23 includes a plurality of apertures 53, one located over each of the LEDs 22 and is shaped to hold down the PCB 21 and to conform and mate snugly with the vertical sides 37, 39 of the fixture body 13. In one embodiment, each aperture 53 is shaped to control the light distribution from each of the LEDs 22 and to redirect the light distribution of the LEDs to enhance the distribution toward a task such as wall washing and wall grazing. Additionally, single sided or double sided films, e.g. 146 (FIG. 10), may be inserted on the underside of the lens 27 and held in place by protrusions 160 (FIG. 3) to alter the light distribution in a desired manner.

Figure 2:
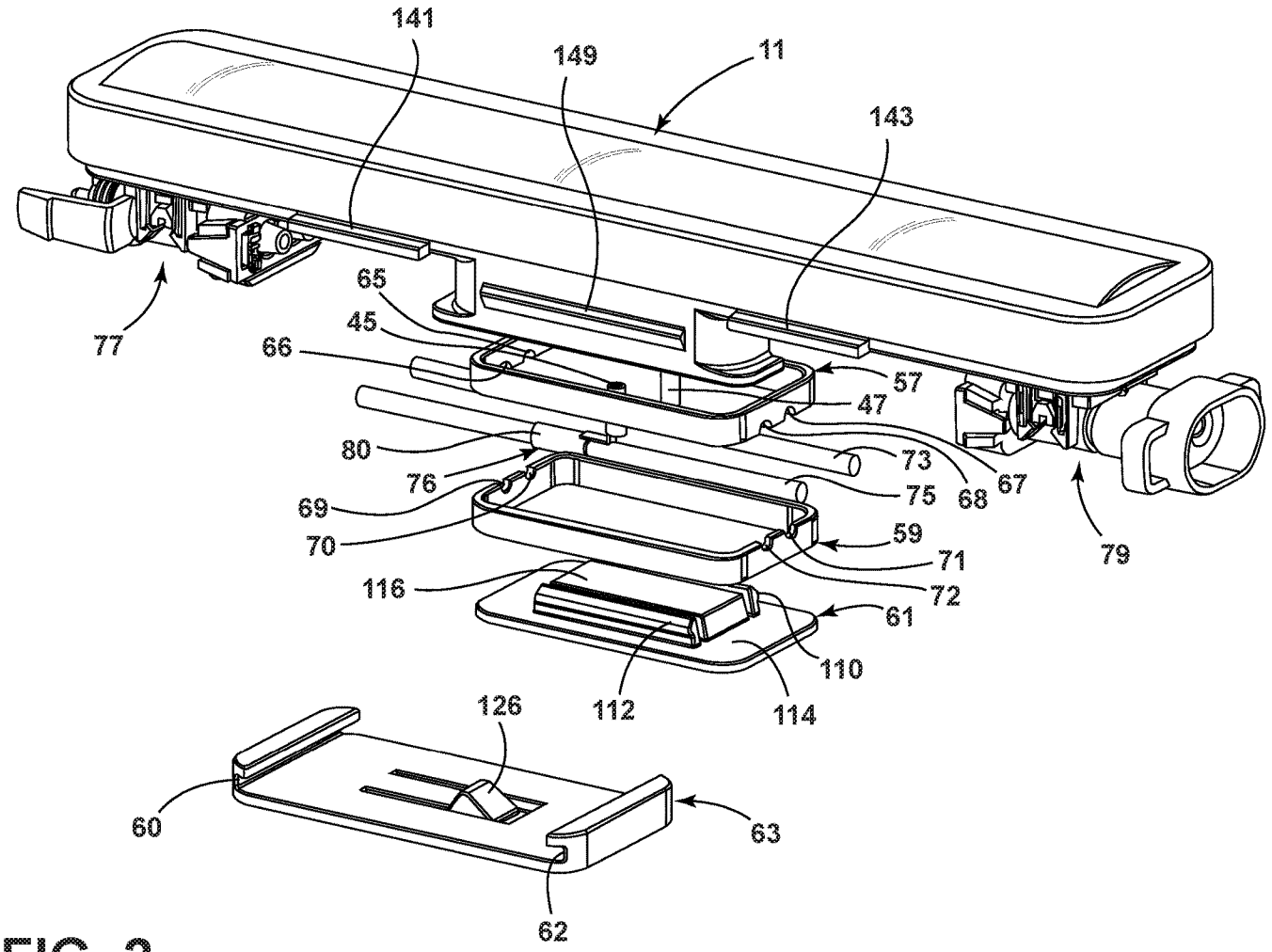
FIG. 2 is an exploded perspective view illustrating wire sealing componentry of the illustrative embodiment.

As shown in FIGS. 1 and 2, the light fixture 11 further includes a box-shaped wire sealing compartment 55, which receives upper and lower rectangular gaskets 57, 59, a snap-in cover 61, and a cover lock 63. As shown in FIG. 2, the upper gasket 57 includes pairs of horizontal wire entry and exit grooves 65, 66; 67, 68; and the lower gasket 59 includes pairs of horizontal entry and exit grooves 69, 70; 71, 72, which receive respective the electrical lead wires 73, 75. Each lead wire 73, 75 has a respective electrically conductive contact attached thereto, each of which has a respective horizontal portion 80, 82, each of which wraps about and pierces a respective lead wire 73, 75 and forms into a respective one of the vertically disposed contact pins 45, 47. In the assembled state, in an illustrative embodiment, the vertical electrical contact pins 45, 46 pass through the PCB 21 to its top surface and supply power to the LEDs 22. As may be appreciated, in the illustrative embodiment, the lead wires 73, 75 pass uninterrupted through the wire sealing compartment 55.

In an illustrative embodiment, the fixture body 13 and its wire sealing compartment 55 may be formed as a single piece from, for example, an extruded, thermally conductive metal material such as aluminum. The mounting plate 15 may be fabricated of aluminum, the circuit board 21 may be made of aluminum, and the PCB cover 23 may be fabricated from polycarbonate. In one embodiment, the lens or light transmissive cover 27 may have a curved transparent or clear portion 28 surrounded by rectangular body 30 and may be made of polycarbonate. In one embodiment, the rectangular body 30 may be opaque or may be diffused, for example, by a heavy etching process. In other embodiments, the curved portion 28 may be frosted, and may or may not shape the light distribution of the fixture 11. The gasket material for the various gaskets may be silicone or any other equivalent outdoor UV rated gasket material. Other suitable materials can of course be used for these various components in other embodiments.

Figure 4:
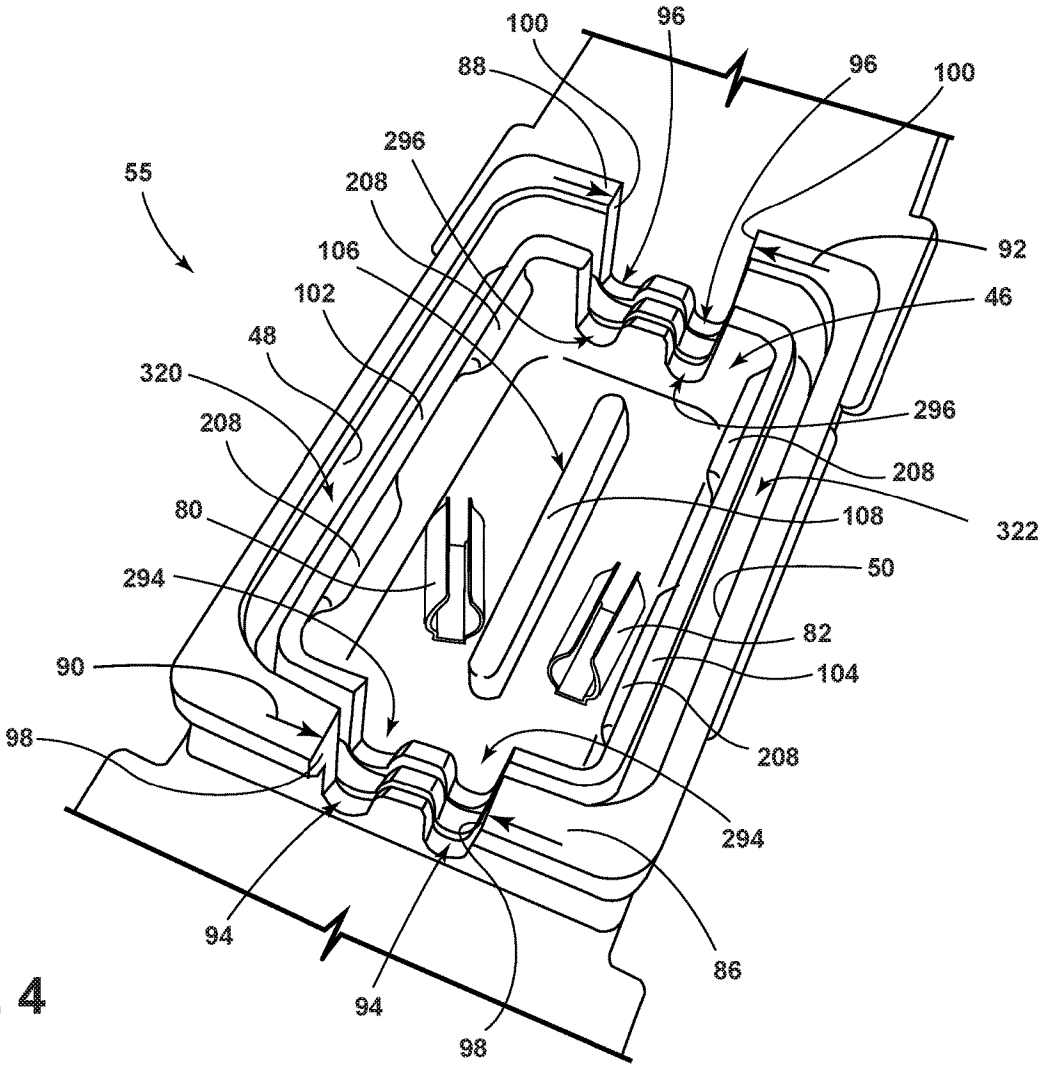
FIG. 4 is a bottom perspective view illustrating the wire sealing compartment of FIG. 1.

As illustrated in FIG. 4, the wire sealing compartment 55 includes an interior space 46, which has respective parallel vertical interior sidewalls 48, 50 with orthogonally disposed vertical entry and exit walls 86, 88. The exit and entry walls 86, 88 have respective entry and exit openings 90, 92 with vertical sidewalls 98, 100. Respective wire entry and exit channels or grooves 94, 96 are formed in the bottom of the entry and exit openings 90, 92. In one embodiment, the exit and entry openings 90, 92 and the wire entry and exit channels or grooves 94, 96 may be identically shaped.

Within the interior space 46 are located vertical ribs 102, 104, which are spaced apart from and run parallel to each of the interior sidewalls 48, 50 and a portion of the entry and exit walls 86, 88, so as to form openings 106, 108, which, in one embodiment, conform to the shape of the openings 90, 92 in the entry and exit walls 86, 88, and which include wire entry and exit channels or grooves 294, 296. The interior space 46 further includes a centrally positioned vertical rib or wire guide 106, which serves to separate and guide the respective leads 73, 75.

The interior space 46 further includes horizontal ribs 208, which project horizontally from the inner side surfaces of the respective vertical ribs 102, 104. These horizontal ribs 208 are shaped and dimensioned to snap-fittingly engage with respective resilient wings 110, 112 formed on the interior surface 114 of the snap-in cover 61 (FIG. 2). A centrally positioned rectangular block 116 formed on the interior surface 114 of the snap-in cover 61 is shaped to contact the top surface 118 of the vertical wire guide 106 to thereby define enclosed spaces through which pass a respective one of the electrical lead wires 73, 75.

Figure 5:
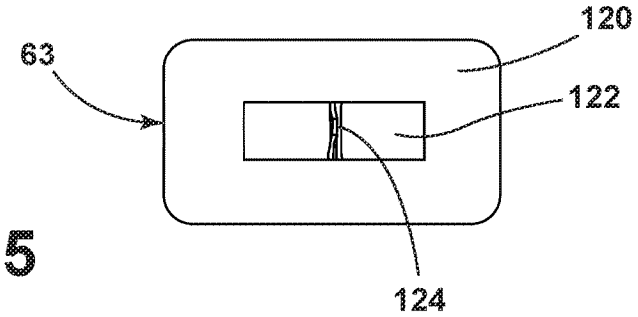
FIG. 5 is a top view of the cover lock component of FIG. 1.

As shown in FIG. 5 the interior surface 120 of the cover lock 63 includes two side channels 60, 62 positioned to slide onto respective ends of snap-in cover 61. The cover lock further includes a rectangular depression 122, which contains a cross bar 124. The cross bar 124 engages the resiliently mounted snap tab 126 (FIG. 2) of the cover lock 63. In operation, the two pieces 63, 64 slide together until the snap tab 126 on the cover lock 63 pops into the retaining hole in the snap-in cover 61. In one embodiment, the cover 61 and the cover lock 63 may be molded plastic components.

To assemble the wire sealing apparatus, the first gasket 57 is inserted into the channels 220, 222 defined by the vertical ribs 102, 104. The electrical leads 73, 75 are then placed into their respective wire entry and exit way channels 65, 66; 67, 68 of the first gasket 57 and into the wire exit and entry channels 94, 294; 96, 296 of the wire sealing compartment 55. The second gasket 59 is then inserted into the channels 320, 322 (FIG. 4) defined by the vertical ribs 102, 104 with the electrical leads 73, 75 placed in their respective channels 69, 70; 71, 72 in the second gasket 59. The snap-in cover 61 is then installed and snapped into place, thereby compressing the gaskets 57, 59, so as to create a watertight seal around the electrical leads 73, 75. The cover lock 63 is then slid into place such that the resilient lock pin 116 engages the snap-in cover 61 and holds the snap-in cover 61 in place.

Figure 11:
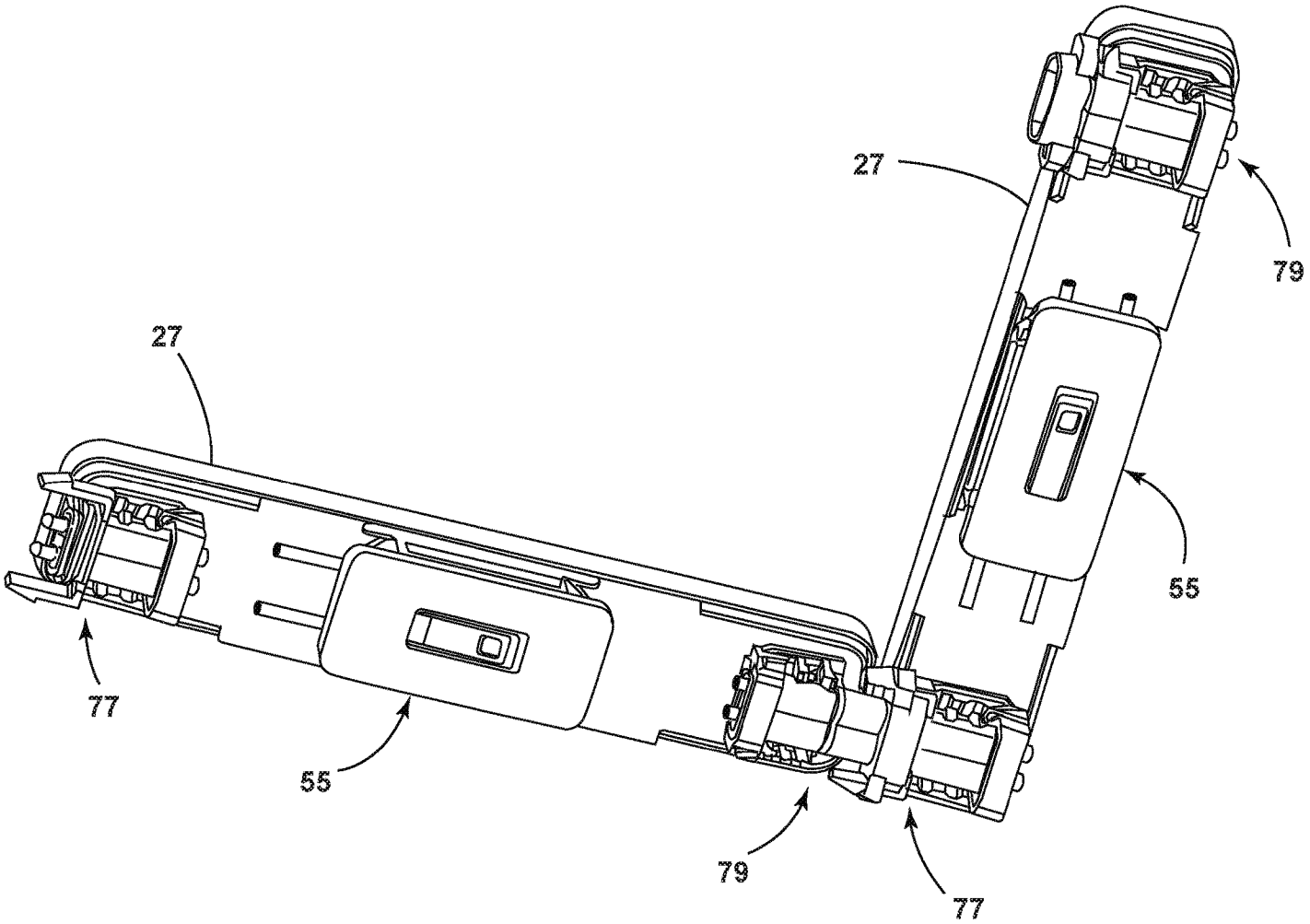
FIG. 11 is a bottom view illustrating two of the light fixtures of FIG. 1 pivotally attached to one another.
Figure 12:
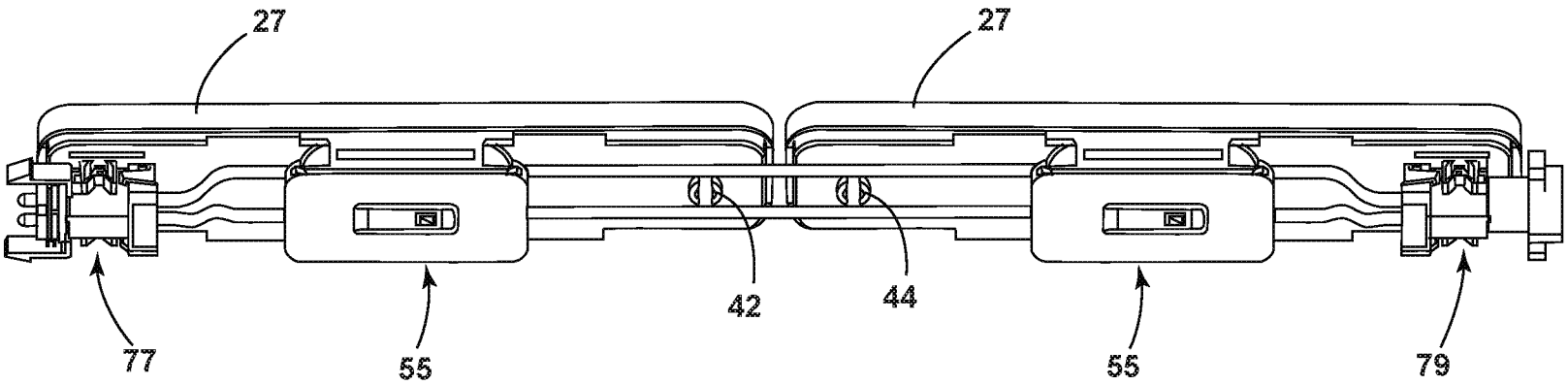
FIG. 12 is a perspective bottom view illustrating interconnection of adjacent light fixtures according to an illustrative embodiment.

FIG. 1 further illustrates male and female electrical connectors 77, 79, which are configured to mate with one another Each connector 77, 79 includes a connector body 81, 83, contact pin pairs 85, 87, a gasket 89, 91, and an end cover 93, 95. In the illustrative embodiment, each of the electrical connectors 77, 79 snap-fits onto a respective swivel base connector 97, each of which in turn snap-fits onto and pivots about a respective split post 42, 44 (FIG. 12). In this manner, one light fixture 11 may be interconnected to another light fixture 11 such that the fixtures 11 may pivot with respect to one another when the male connector 77 of one light fixture 11 is plugged into the female connector 79 of another light fixture 11, as illustrated in FIG. 11.

Figure 6:
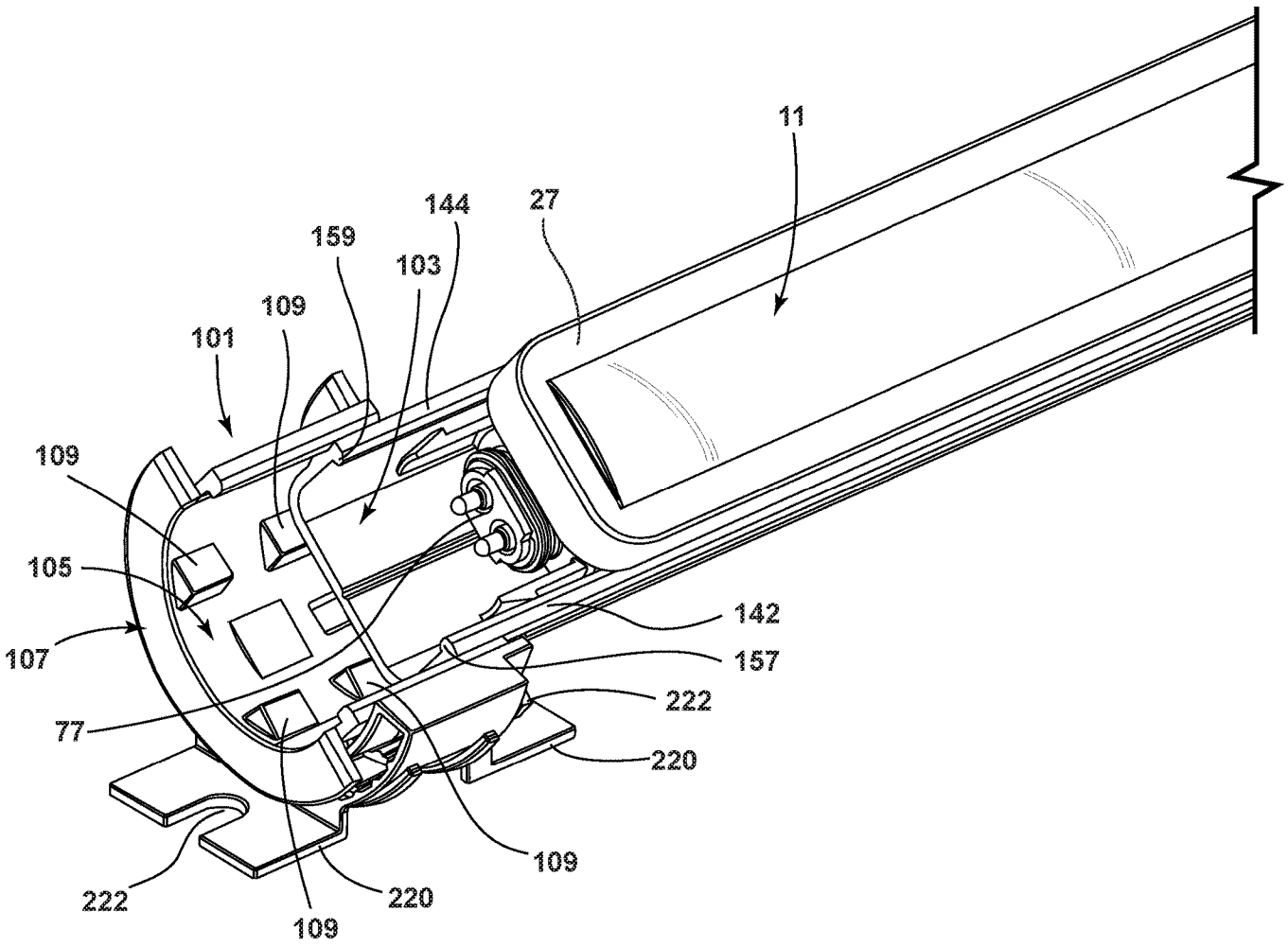
FIG. 6 is a fragmentary perspective view illustrating a turret mechanism for rotatably mounting the light fixture apparatus of FIG. 1.

In an illustrative embodiment, a turret mechanism 101 shown in FIGS. 6-10 is provided to mount one or more light fixtures 11 to facilitate aiming the fixture's light output through a range of angles. As shown in FIG. 6, the light fixture 11 is mounted in a receptacle 103 of rectangular or U-shaped cross-section. The receptacle 103 mounts in a rotating bracket component 105 of the turret mechanism 101. The rotating bracket component 105 is in turn mounted to rotate in a cradle 107 and includes a number of steps 109 on its semicircular interior surface on which the receptacle 103 rests.

Figure 7:
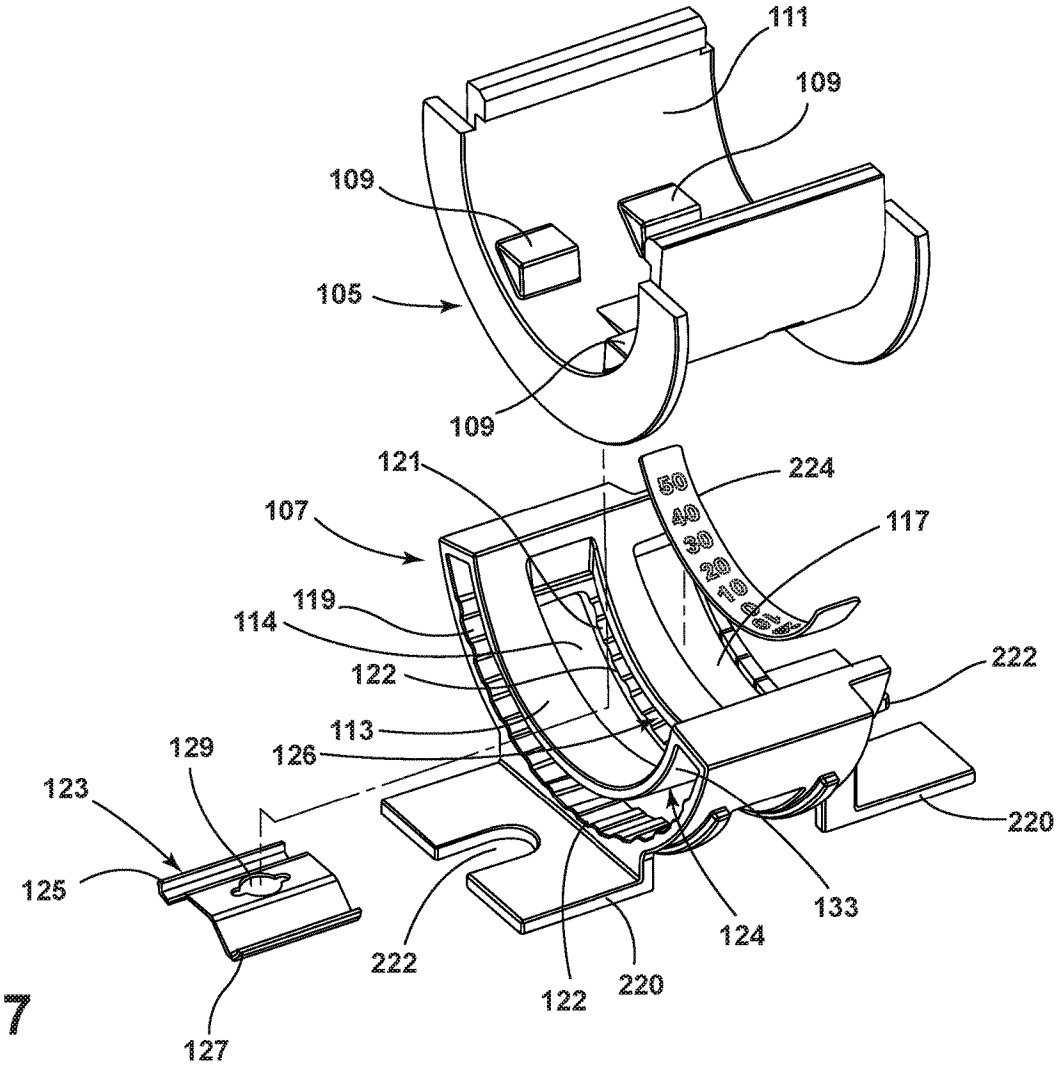
FIG. 7. is an exploded perspective view of the turret mechanism.

As shown in FIG. 7, the cradle 107 includes a semicircular interior surface 113 having a semicircular opening 114 and a semicircular recessed surface 117 formed therein. The semicircular interior surface 113 is spaced apart on each side from respective semicircular ratchet surfaces 119, 121, each of which has a plurality of ratchet teeth, e.g., 122, formed thereon. Respective feet 220 are formed on either side of the cradle 107 and have slots 222 formed therein, which facilitate attachment of the cradle 107 to a surface to which the light fixture 11 is to be mounted.

As further shown in FIG. 7, a spring component 123 is shaped to fit in the gaps 124, 126 between the semicircular interior surface of the cradle 107 and the respective ratchet surfaces 119, 121. The spring component 123 has respective edges 125, 127 shaped to engage the ratchet teeth 122 on each side of the cradle 107 and further has a central opening 129 therein. In one embodiment, a fastening device is inserted through an opening 131 (FIG. 8) in the rotating bracket 105 in order to attach the rotating bracket 105 to the spring component 123.

Figure 8:
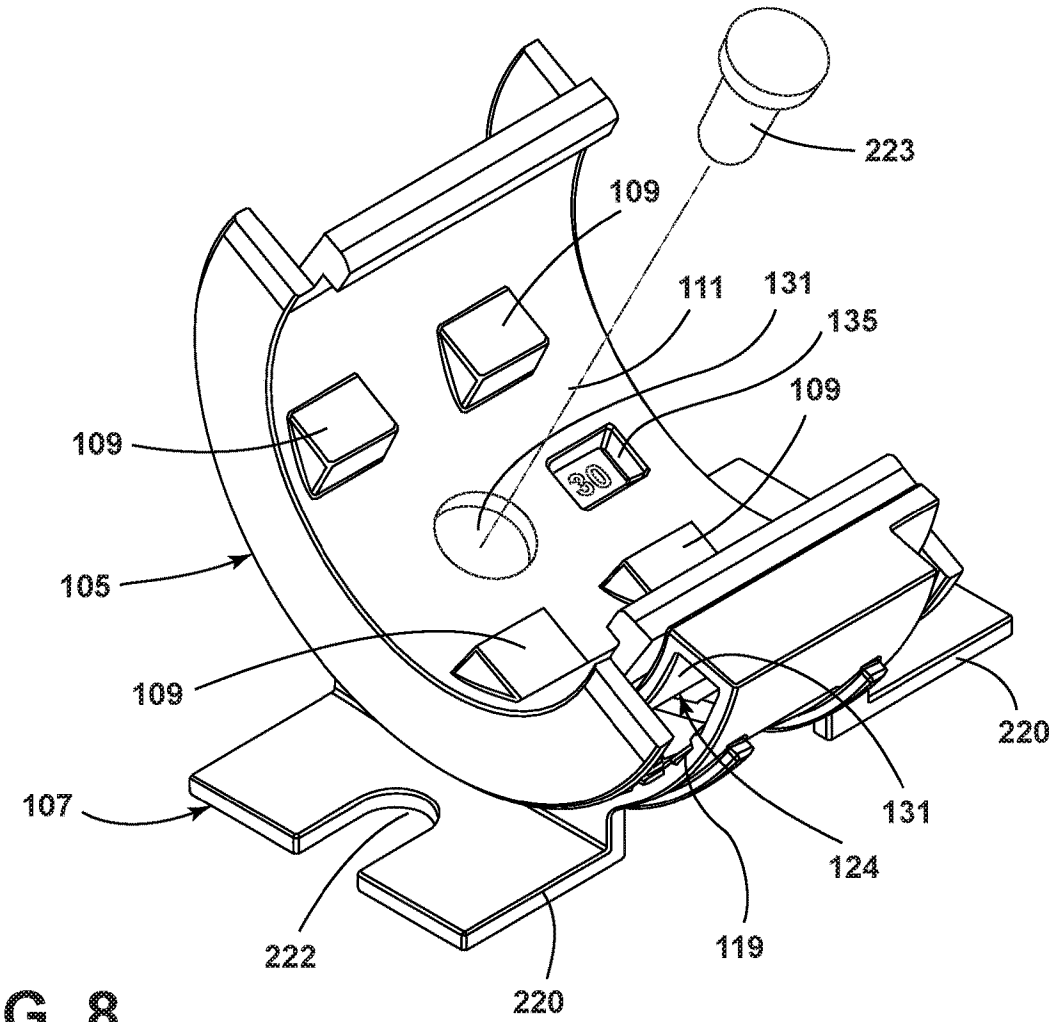
FIG. 8 is a perspective view of the turret mechanism in an assembled state.
Figure 9:
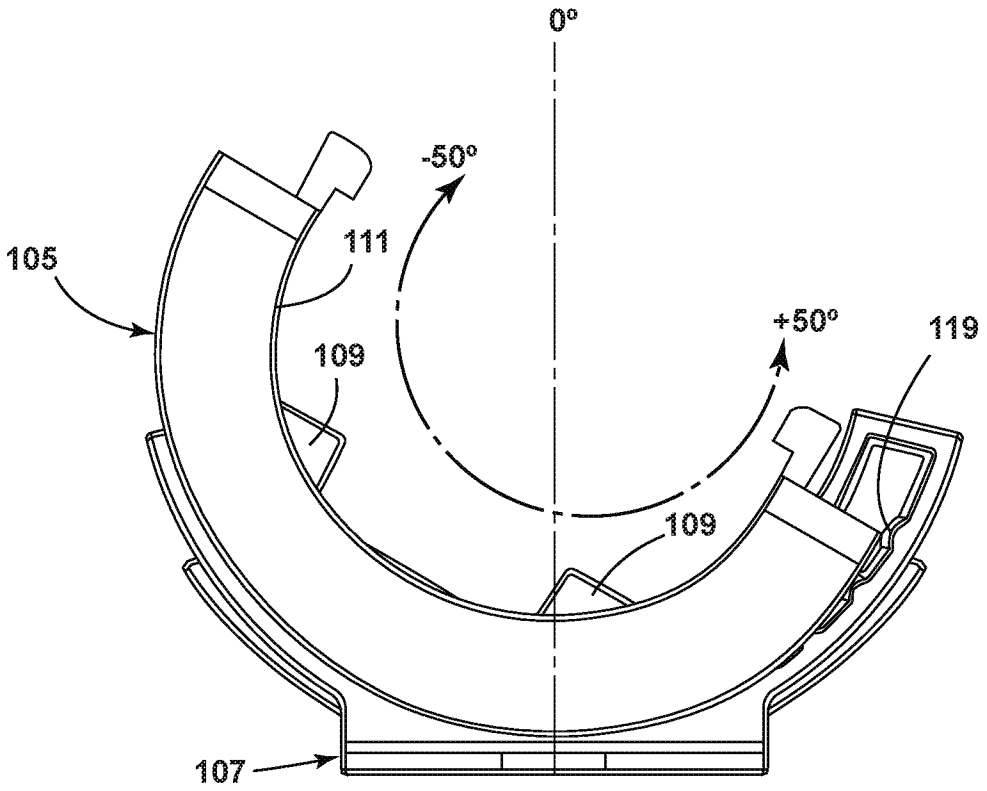
FIG. 9 is a side view of the turret mechanism.

The spring component 123 and rotating bracket 105 are shaped and dimensioned such that the rotating bracket 105 is pivotable with respect to the cradle 107 and can click into position at various selected angles. As shown in FIG. 9, in an illustrative embodiment, the rotating bracket 105 can pivot through a range of angles from −50 to +50 degrees as illustrated in FIG. 9 and stops every 10 degrees. An angle adjustment label 224 (FIG. 7) may be applied to the recessed surface 117 of the cradle 107, such that the angle at which the bracket 105 is positioned may be read through a window opening 135 in the bracket 105 as shown in FIG. 8. In one embodiment the components of the turret mechanism may be injection molded plastic components with a stainless steel spring 123, which may be held in place by a rivet, plastic pin, or other suitable fastening device 223.

Figure 10:
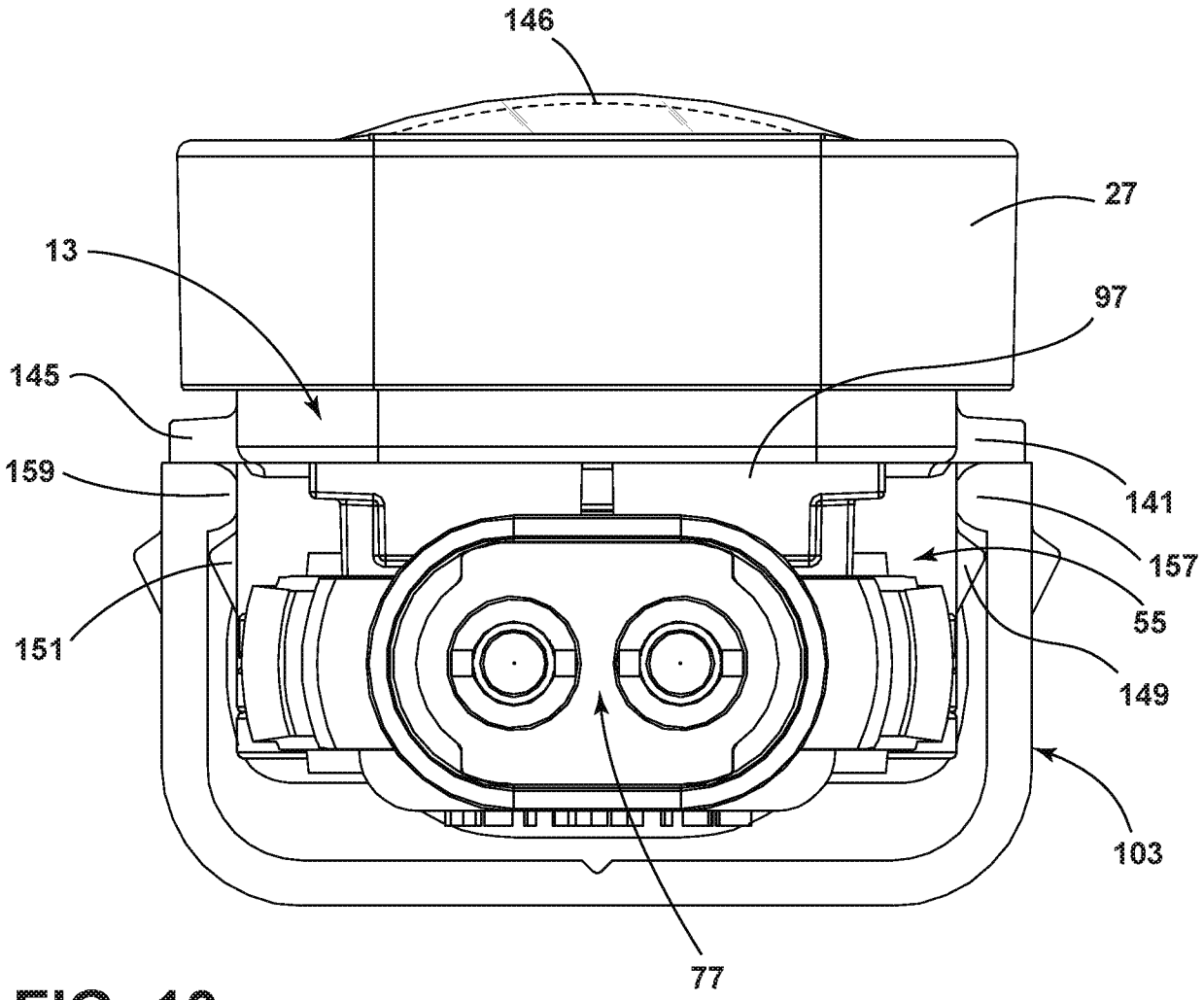
FIG. 10 is an end view of a light fixture of an illustrative embodiment mounted in a receptacle component of the turret mechanism.

FIG. 10 illustrates the manner in which the light fixture 11 slidingly mates with the receptacle 103. In particular, wings, e.g. 141, 143, 145 extending from the sides of the fixture body 13 ride on respective top surfaces 142, 144 of respective nubs 157, 159 formed at the top edges of the receptacle 103. At the same time, wedge-shaped projections 149, 151 formed on each side of the wire sealing compartment 55 of the light fixture 11 are respectively positioned beneath the nubs 157, 159 such that the light fixture 11 may be inserted onto the receptacle 103. In one embodiment, the nubs 157, 159 may run the entire length of the receptacle 103 and lateral friction between wedge shaped projections 149,151 and the inner walls of receptacle 103 prevents movement along the longitudinal axis of receptacle 103.

From the foregoing, it will be appreciated that light fixtures according to the illustrative embodiments can be constructed which require no fasteners or tools for assembly and which are easily installed and easily disassembled, for example for gasket or circuit board removal.

Thus, those skilled in the art will appreciate that various adaptations and modifications of the just described illustrative embodiments can be configured without departing from the scope and spirit of the invention. Therefore, it is to be understood that, within the scope of the appended claims, the invention may be practiced other than as specifically described herein.

What is claimed is:

1. Light fixture apparatus comprising:

a fixture body;

a light transmissive cover removably attachable to the fixture body;

one or more LEDs located within the fixture body and positioned to direct light through the light transmissive cover;

a wire sealing compartment located on an underside of the fixture body and defining an open interior space configured to receive first and second electrical leads; and first and second gaskets positioned within an interior of the wire sealing compartment and configured to pass and sealingly engage said first and second electrical leads.

2. The light fixture apparatus of claim 1 further comprising a snap-in cover which compresses the first and second gaskets and closes a bottom opening of the wire sealing compartment.

3. The light fixture apparatus of claim 2 further comprising a cover lock configured to lock the snap-in cover in place.

4. The light fixture apparatus of claim 1 wherein the wire sealing compartment comprises respective parallel vertical interior sidewalls with an orthogonally disposed vertical entry wall joining the parallel sides at first ends thereof and an orthogonally disposed exit wall joining the parallel sides at second ends thereof and wherein the exit and entry walls have respective entry and exit openings formed therein, the entry opening including a pair of wire entry grooves shaped to receive said first and second electrical leads, the exit opening including a pair of wire exit grooves shaped to receive said first and second electrical leads.

5. The light fixture apparatus of claim 4 wherein the exit and entry openings are identically shaped.

6. The light fixture apparatus of claim 5 wherein the exit and entry openings each have parallel vertical side edges.

7. The light fixture apparatus of claim 6 wherein the vertical sidewalls and exit and entry sidewalls meet at respective rounded corners.

8. The light fixture apparatus of claim 4 further comprising first and second vertical ribs respectively spaced apart from, and running parallel to, each of the vertical interior sidewalls, the vertical ribs defining respective channels into which each of the first and second gaskets fit.

9. The light fixture apparatus of claim 8 wherein the first and second vertical ribs further include a portion spaced apart from and running parallel to the entry and exit walls and forming respective first and second openings through which said first and second leads pass.

10. The light fixture apparatus of claim 9 wherein the shape of the first and second openings conforms to the shape of the entry and exit openings in the entry and exit walls.

11. The light fixture apparatus of claim 8 further including a centrally positioned vertical wire guide on a floor of the wire sealing box which serves to separate and guide the respective electrical leads.

12. The light fixture apparatus of claim 1 wherein the one or more LEDs are mounted on a printed circuit board positioned within the fixture body and further comprising a cover mounted over the one or more LEDs and having a plurality of apertures, each aperture being positioned over a respective one of the one or more LEDs.

13. The light fixture apparatus of claim 12 wherein each of the plurality of apertures is shaped to alter the light distribution pattern of the light fixture apparatus.

14. The light fixture apparatus of claim 1 further comprising:

a receptacle shaped to receive and hold the fixture body and its wire sealing compartment; and a turret mechanism configured to pivotally mount the receptacle, the turret mechanism comprising:

a cradle component having a semicircular exterior surface and having a plurality of ratchet teeth located in first and second semicircular channels positioned on respective sides thereof a bracket component configured to receive and hold the receptacle, the bracket component having a semicircular interior surface shaped to pivotally mate with the semicircular exterior surface of the cradle component; and a spring component attached to said bracket component and configured to engage said ratchet teeth so as to enable the bracket component to be pivoted to a selected angle with respect to the cradle component and fixed in position at that angle.

15. The light fixture apparatus of claim 3 wherein the light transmissive cover snaps on to the fixture body, wherein the snap-in cover snaps into the wire sealing compartment, and wherein the cover lock resiliently engages the snap-in cover.

16. The light fixture apparatus of claim 1 wherein the wire sealing compartment is box-shaped.

17. Light fixture apparatus comprising:

a fixture body;

a light transmissive cover removably attachable to the fixture body;

one or more LEDs located within the fixture body and positioned to direct light through the light transmissive cover;

a wire sealing compartment formed as a unitary part of the fixture body and located on an underside thereof, the wire sealing compartment defining an open interior space configured to receive first and second electrical leads;

first and second gaskets installed in an interior of the wire sealing compartment and sealingly engaging said first and second electrical leads in watertight fashion.

18. The light fixture apparatus of claim 17 further comprising a snap-in cover which compresses the first and second gaskets and closes a bottom opening of the wire sealing compartment.

19. The light fixture apparatus of claim 18 further comprising a cover lock configured to lock the snap-in cover in place.

20. The light fixture apparatus of claim 17 wherein the wire sealing compartment comprises respective parallel vertical interior sidewalls with an orthogonally disposed vertical entry wall joining the parallel sides at first ends thereof and an orthogonally disposed exit wall joining the parallel sides at second ends thereof and wherein the exit and entry walls have respective entry and exit openings formed therein, the entry opening including a pair of wire entry grooves shaped to receive said first and second electrical leads, the exit opening including a pair of wire exit grooves shaped to receive said first and second electrical leads.

21. The light fixture apparatus of claim 20 wherein the exit and entry openings are identically shaped.

22. The light fixture apparatus of claim 21 wherein the exit and entry openings each have parallel vertical side edges.

23. The light fixture apparatus of claim 22 wherein the vertical sidewalls and exit and entry sidewalls meet at respective rounded corners.

24. The light fixture apparatus of claim 20 further comprising first and second vertical ribs respectively spaced apart from, and running parallel to, each of the vertical interior sidewalls, the vertical ribs defining respective channels into which each of the first and second gaskets fit.

25. The light fixture apparatus of claim 24 wherein the first and second vertical ribs further include a portion spaced apart from and running parallel to the entry and exit walls and forming respective first and second openings through which said first and second leads pass.

26. The light fixture apparatus of claim 25 wherein the shape of the first and second openings conforms to the shape of the entry and exit openings in the entry and exit walls.

27. The light fixture apparatus of claim 25 further including a centrally positioned vertical wire guide on a floor of the wire sealing box which serves to separate and guide the respective electrical leads.

28. The light fixture apparatus of claim 17 wherein the one or more LEDs are mounted on a printed circuit board positioned within the fixture body and further comprising a cover mounted over the one or more LEDs and having a plurality of apertures, each aperture being positioned over a respective one of the one or more LEDs.

29. The light fixture apparatus of claim 28 wherein each of the plurality of apertures is shaped to alter the light distribution pattern of the light fixture apparatus.

30. The light fixture apparatus of claim 17 further comprising:

a receptacle shaped to receive and hold the fixture body and its wire sealing compartment; and a turret mechanism pivotally mounting the receptacle, the turret mechanism comprising:

a cradle component having a semicircular exterior surface and having a plurality of ratchet teeth located in first and second semicircular channels positioned on respective sides thereof;

a bracket component mounting the receptacle, the bracket component having a semicircular interior surface shaped to pivotally mate with the semicircular exterior surface of the cradle component; and a spring component attached to said bracket component and engaging said ratchet teeth so as to enable the bracket component to be pivoted to a selected angle with respect to the cradle component and fixed in position at that angle.

* * * * *